US006984608B2

(12) United States Patent
Makitalo et al.

(10) Patent No.: US 6,984,608 B2
(45) Date of Patent: Jan. 10, 2006

(54) METHOD OF MANUFACTURING HEAT SENSITIVE RECORDING MATERIAL AND HEAT SENSITIVE RECORDING MATERIAL

(75) Inventors: Jouka Makitalo, Eura (FI); Elina Mattila, Köyliö (FI)

(73) Assignee: Jujo Thermal Oy, Kauttua (FI)

( * ) Notice: Subject to any disclaimer, the term of this patent is extended or adjusted under 35 U.S.C. 154(b) by 4 days.

(21) Appl. No.: 10/478,872

(22) PCT Filed: May 24, 2002

(86) PCT No.: PCT/FI02/00445

§ 371 (c)(1),
(2), (4) Date: Dec. 18, 2003

(87) PCT Pub. No.: WO02/094575

PCT Pub. Date: Nov. 28, 2002

(65) Prior Publication Data

US 2004/0171486 A1 Sep. 2, 2004

(30) Foreign Application Priority Data

May 25, 2001 (FI) ..... 20011094

(51) Int. Cl.
*B41M 5/30* (2006.01)

(52) U.S. Cl. ..... 503/217; 503/216; 503/221; 503/225

(58) Field of Classification Search ..... 503/216, 503/217, 221, 225
See application file for complete search history.

(56) References Cited

U.S. PATENT DOCUMENTS

| | | | | |
|---|---|---|---|---|
| 4,916,111 | A | 4/1990 | Yaguchi et al. | 503/226 |
| 5,084,593 | A | 1/1992 | Gotoh et al. | 558/405 |
| 5,250,493 | A | 10/1993 | Ueda et al. | 503/220 |

FOREIGN PATENT DOCUMENTS

| | | |
|---|---|---|
| EP | 0 546 836 | 6/1993 |
| EP | 0 968 837 | 1/2000 |

*Primary Examiner*—Bruce H. Hess
(74) *Attorney, Agent, or Firm*—Nixon & Vanderhye P.C.

(57) ABSTRACT

The present invention relates to a method of manufacturing heat sensitive recording material for the bar code reader wavelength range of 660–690 nm, the recording material containing a base layer and a coating, and the coating containing at least a color former and a developer. The method of the invention is characterized in that the color former and the developer are selected so that when the reflectance of the color former-developer compound on the recording material is determined, it remains below a target curve determined with a function $Hp=1.775*Ap^{22*}10^{-61}$, where Hp is the reflectance percent and Ap the wavelength (nm) used in the bar code reader.

2 Claims, 5 Drawing Sheets

METHOD OF MANUFACTURING HEAT SENSITIVE RECORDING MATERIAL AND HEAT SENSITIVE RECORDING MATERIAL

This application is the US national phase of international application PCT/FI02/00445 filed 24 May 2002 which designated the U.S.

The present invention relates to a method of manufacturing heat sensitive recording material and to the heat sensitive material. In particular the inventions is applicable in manufacturing a heat sensitive material so that the material in question has a better bar code readability than before. Further, the invention relates to a heat sensitive recording material having an improved bar code readability.

Heat sensitive material is typically paper or corresponding material composed of several layers and used typically in sheet or roll form. The main layers are base paper or corresponding material, and coating. Further, at least a color forming agent, a developing agent and a sensitizing agent are situated in the coating. When heated to a suitable temperature the coating melts, in some cases softens or sublimates, thus allowing reactions of other components of the coating, whereby, as a consequence of the chemical reaction, a colored trace is produced in the recording material.

In the following, a few patent documents disclosing the use of Bisphenol S, a nowadays-popular color former, has been discussed in more detail.

EP-A-0968837 discusses a thermally sensitive recording medium, which comprises; on a substrate; a thermally sensitive color developing layer comprising a colorless or a pale colored dye precursor and a color developer. The document concentrates on developing a black color with a maximum absorption wavelength of 420–480 nm and 550–640 nm. The used color former is Bisphenol S.

EP-A-0546836 discusses a thermally sensitive recording material with improved thermal response for a given total coat weight of thermally sensitive composition or image-forming components. The thermally sensitive recording material has the thermally sensitive composition applied separately in two or more adjacent layers, each of which contains color developing co reactant material, rather than in the conventional single layer. The adjacent thermally sensitive layers are formulated such that together they generate a substantially single color final print in response to heat energy input. The color developing co reactant materials in the layers may be the same or different and are typically bisphenols, like for instance Bisphenol S.

U.S. Pat. No. 5,084,593 discloses a recording material using Bisphenol S, among other color developers, as the color developer compound. The document is mainly concerned on discussing various leuco dye alternatives.

U.S. Pat. No. 4,916,111 discloses a thermo sensitive recording material comprising a support, an intermediate layer including a foamed portion with minute voids on the support, and a thermo sensitive coloring layer formed on the intermediate layer is disclosed, which is particularly improved in such a manner that the voidage of the upper portion of the intermediate layer close to the thermo sensitive coloring layer is smaller than the voidage of the lower portion of the intermediate layer close to the support, or the voidage of the intermediate layer is increased from the upper portion thereof towards the lower portion thereof. Among dozens of color developers, Bisphenol S is mentioned.

U.S. Pat. No. 5,250,493 discloses a thermo sensitive recording material having a support and a thermo sensitive coloring layer formed on the support, which thermo sensitive coloring layer includes at least a first thermo sensitive coloring layer containing at least one leuco dye, and a color developer capable of inducing color formation in the leuco dye under application of heat thereto, and a second thermo sensitive coloring layer containing at least one leuco dye, and a color developer capable of inducing color formation in the leuco dye under application of heat thereto. The leuco dye for use In the first thermo sensitive coloring layer has the absorption intensity in the near infrared region, and the leuco dye for use in the second thermo sensitive coloring layer has the absorption intensity in the visible spectrum. As one of the color developers Bisphenol S is mentioned.

Further, patent documents EP-A-0 968 837, U.S. Pat. No. 5,256,621 and U.S. Pat. No. 6,093,678, among others, may be mentioned as examples of patent literature discussing heat sensitive recording material in general.

Heat sensitive recording material, i.e. so-called thermal paper, is used for example in various stickers, tags and labels; based on the bar code printed on them the products or the properties, for example the price, of the products thus marked can be recognized automatically. A separate bar code reader is used for the recognition of the bar code. A characteristic feature in the operation of a bar code reader is that light is directed from the reader to the bar code and it reflects back from the white spaces between the bars of the bar code but does not reflect, or at least reflects substantially weaker, from the bar code itself. Bar code readers have been developed over the years in order to achieve a better, faster, more accurate and more faultless recognition of the code. For example, the wavelength of the light used in new bar code readers has been changed. The wavelength used earlier in bar code readers has been shorter, approx. 600–630 nm, than in the present light sources. Today, LED- or laser-type bar code readers are used which provide a higher reading speed and also a more accurate code recognition not to mention the lower production costs of the devices. However, LED- and laser-type bar code readers use light with a wavelength of 660–690 nm.

When new bar code readers have been introduced, the use of prior art thermal paper has caused problems in the readability of the bar code. Customers have complained about disturbances occurring with certain readers using a LED or a laser light source. Our tests, in which perhaps the most commonly used color forming agent, 3-(N-ethyl-N-isopentylamino)-6-methyl-7-anilinofluoran, commercial name S205, and a new, very popular 3-(diethylamino)-6-methyl-7-(3-methylphenylamino)fluoran, which is known under the commercial name ODB-7, were used as the color forming agent, and the most common 4,4'-isopropylidenediphenol, commercial name BPA, and 4-hydroxy-4'-isopropoxydiphenylsulfon, commercial name NY-DS, as the developer, have shown that the introduction of another light wavelength has resulted in that the paper properties, more precisely the light absorption or reflectance properties, are no longer suitable for the new type of light and the recognition of the bar code has deteriorated.

When this was studied it was found out that the reflecting properties of a bar code changed dramatically when moving from the prior art light wavelength (about 630 nm) upwards. This is illustrated in FIGS. 1, 2 and 3. It was found out, among other things, that with conventional bar code papers and the light wavelength (approx. 630 nm or less) employed by prior art bar code readers, less than 10% of the light used was reflected from the bar code bars whereas with the equipment of new technology, even more than 50% of the light was reflected. At the same time, it was found out that with the wavelength of 630 nm, there were no significant differences between different color formers and developers in the luminous reflectance whereas with longer wavelengths different color former-developer compounds gave very different reflections.

At first this was thought to be at least partly due to the density of the bar code but, to a substantial extent, that is, however, not the reason. An increase in the density reduced the total reflectance by a few percents as a whole, only. In any case, different color former-developer compounds still gave very different and very high reflections.

As the problem was proved to be the reflection of the bar of the bar code and particularly the change in it when the wavelength increased, the study was continued by finding out a limit value curve, which is the minimum requirement the customers have given for the bar code products. Also, color former-developer compounds were looked for with which the results would clearly be under the limit value curve whereby the absorption of light is so strong the reflectance of light does not cause problems in the recognition of the bar code.

Further, a so-called target curve was determined which is located about 7% below the limit value curve. The values of the curve were determined by performing a large number of tests and setting as a target an error margin of one percent in the recognition of the bar code.

Thus, one problem, which the present invention solves, is the readability of the bar code when using LED or laser readers. The invention is based on the idea of using a color former and a color former-developer compound with which the absorption of light is as strong as possible with the desired light wavelength, i.e. 660–690 nm.

The characteristic features of the present invention are disclosed more specifically in the appended patent claims.

The method of the invention is described more in detail below with reference to the accompanying drawing figures of which FIGS. 1 and 2 illustrate reflectance values of bar code bars having two different degrees of optic densities obtained with prior art color formers and developers;

Figure 1:
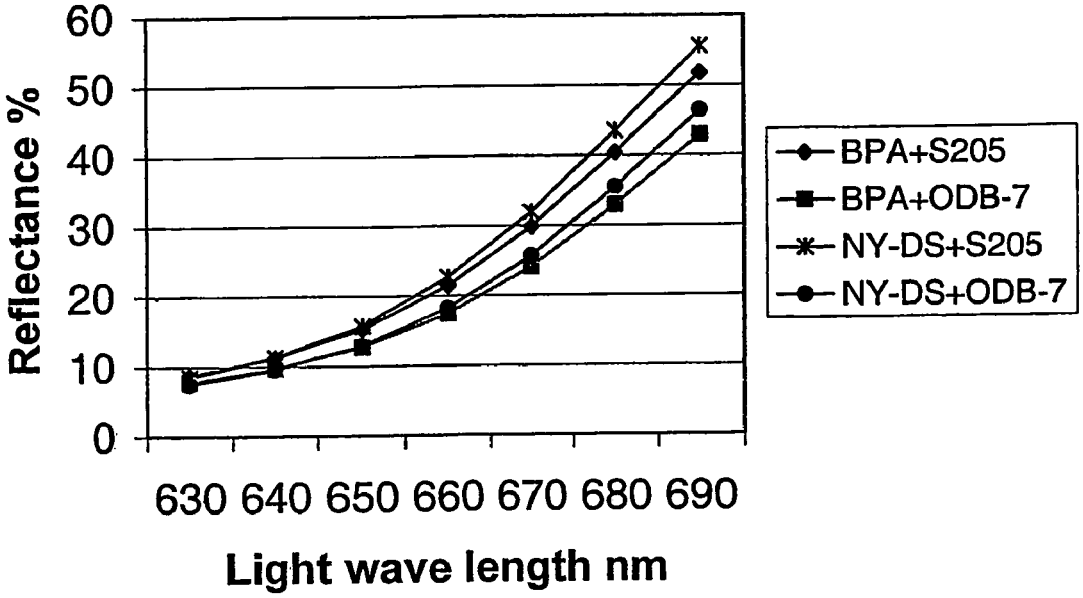

In the situation illustrated by FIG. 1, the bar codes were printed on prior art recording material using prior art color former-developer compounds. Thus, the color formers were S205 and ODB-7 and the developers BPA and NY-DS. FIG. 1 illustrates in percentage the amount of light reflected by the bar code, i.e. the dark bars of it, at a lower optic density, 1.15, as a function of the light wavelength. It can be seen that with the light wavelength (630 nm) used in prior art equipment, less than 10% of the light was reflected by the bar code bars, whereas with the equipment of the modern technology more than 40%, even more than 50% of the light was reflected. Further, it should be noted that with the wavelength 630 nm, there are no significant differences in the reflectance with different color formers and developers, whereas with a longer wavelength, different color former-developer compounds produce very different reflections. Differences with the wavelength of 690 nm are even of the order of more than ten percent, already.

Figure 2:
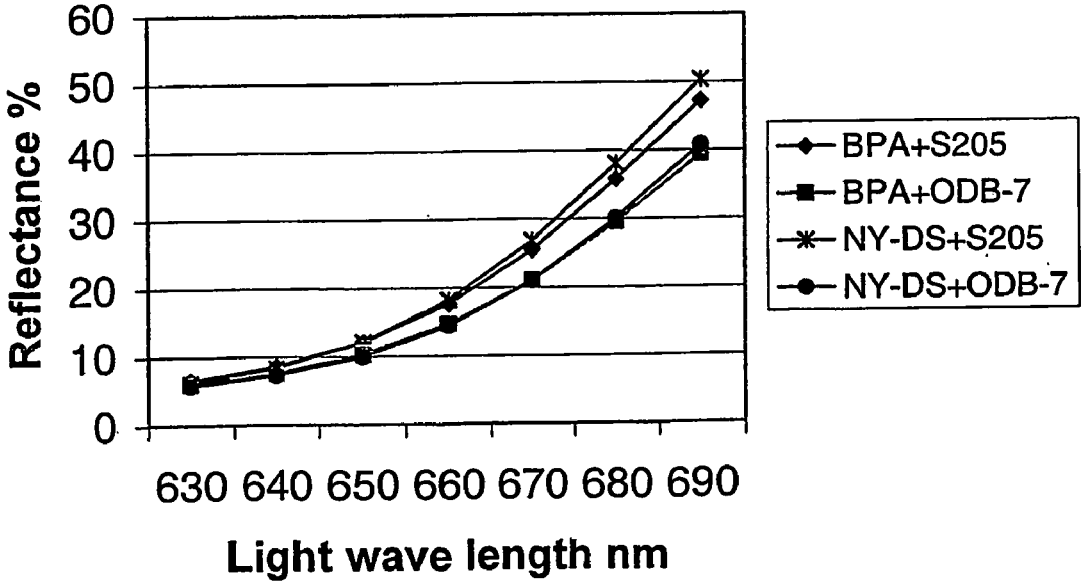

At first it was thought that this was at least partly due to the degree of density of the bar code but FIG. 2 illustrates that, in essence, this is not the case. In the situation illustrated in FIG. 2, the optic density had already been raised to 1.30, which has given a total reflectance decrease of a few percents, only. Anyway, different color former-developer compounds still give very different and very strong reflections. However, the figures illustrate that, of the two developers used, BPA gives with both color formers a slightly weaker reflection (which is a desired property) than NY-DS with the same color formers.

Figure 3:
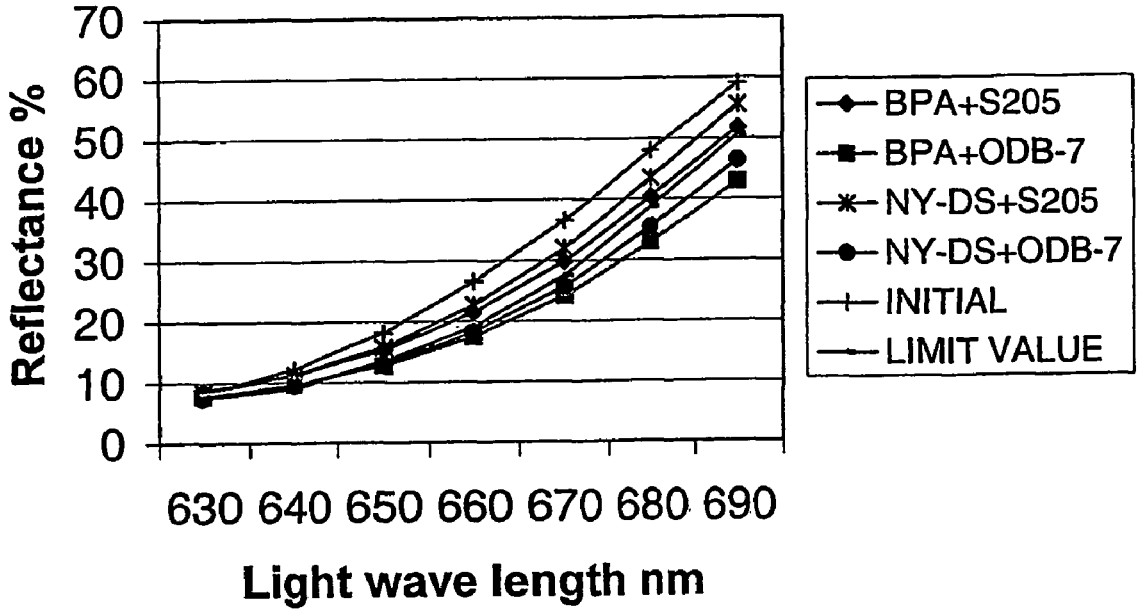
FIG. 3 illustrates an initial curve of reflectance determined by using the prior art products mentioned above and other known bar code products, with a curve for the minimum requirements set by customers.

Since the problem was proved to be the reflection of the bar code bar and in particular the change of it with the increase of the wavelength, the study was continued by determining a limit value curve to the Figures mentioned above based on the requirements of the customers; with the reflection values indicated by the curve, an interpretation of the bar code is obtained, which at least in most cases satisfies the customers. FIG. 3 illustrates, with the curves of the test samples of FIG. 1, the reflectance value curve of a commercial bar code product, which can in a way be considered as the initial point of this development work. The figure also includes a limit value curve drafted based on the requirements of customers which illustrates the maximum values of the reflectance set by the customers. In order to make the interpretation of the bar code so reliable and of so high quality that the customers need not complain about bar code reading problems, the reflections of the bar codes have to be clearly below the above limit value curve.

When the so-called target curve was determined in the way described above, test were started to find a chemical compound, which would give results on the level of the curve or even below it.

The invention is thus based on the idea that different chemical compounds of color formers, developers and sensitizers, the most significant of which have proved to be compounds of color formers and developers, give different light reflection responses at different light wavelengths. The object of the invention was thus to find a chemical compound or compounds, which would produce bar codes not reflecting light at the light wavelength 660–690 nm used in LED or laser-type bar code reading devices as much as bar codes produced with prior art chemical compounds. This would be utilized in bar code reading, which is based on the difference between the high reflection from the background, which is mainly white, and the reflection from the code bar, which is as low as possible, and can be interpreted as a high contrast between the code bar and the background. The end result is that the bar code reader detects the information from the bar code better when the bar code has been printed on thermal paper containing the new chemical compound according to the invention, compared with thermal paper containing prior art chemicals. Thus, the chemical compound according the to present invention has been developed particularly for the light wavelength used in the new type of bar code readers.

In producing a bar code and other images on thermal papers and other heat-sensitive recording materials, developers and color formers are used and commonly also sensitizers, which decrease the melting point of the coating material. Various developers, color formers and sensitizers have been compiled in the following lists. The lists include, among others chemicals, also the developers BPA and NY-DS and color formers S205 and ODB-7 mentioned above.

Developers are for example:

1,3-di[2-(2,4-dihydroxyphenyl)-2propyl]benzene
1,3-di[2-(2-hydroxy-5-methylphenyl)-2propyl]benzene
1,3-di[2-(4-hydroxy-3-alkylphenyl)-2propyl]benzene
1,3-di[2-(4-hydroxyphenyl)-2propyl]benzene
1,3-dihydroxy-6(α,α-dimethylbenzyl)-benzene
1,7-di(hydroxyphenylthio)-3,5-dioxaheptane
2,4-dihydroxybenzophenone
2-hydroxy-5-t-aminophenyl-4'-hydroxyphenylsulfone
2-hydroxy-5-t-butylphenyl-2'-methyl-4'-hydroxyphenylsulfone
2-hydroxy-5-t-butylphenyl-3'-chloro-4'-hydroxyphenylsulfone
2-hydroxy-5-t-butylphenyl-3'-ispropyl-4'-hydroxyphenylsulfone
2-hydroxy-5-t-butylphenyl-3'-methyl-4'-hydroxyphenylsulfone
2-hydroxy-5-t-butylphenyl-4'-hydroxyphenylsulfone
2-hydroxy-5-t-isopropylphenyl-4'-hydroxyphenylsulfone
2-hydroxy-5-t-octylphenyl-4'-hydroxyphenylsulfone
3,3'5,5'-tetrabromo-4,4'-sulfonyidiphenol
3,3'-diamino-4,4'-sulfonyidiphenol
3,3'-dichloro-4,4'-sulfonyidiphenol
3-chloro-4-hydroxyphenyl-3'-isopropyl-4'-hydroxyphenylsulfone
4,2'-sulfonyidiphenol
4,4'-cyclohexylidenediphenol
4,4'-isopropylidenediphenol (also know under commercial name bisphenol A or BPA)
4,4'-sulfonyldiphenol (Bisphenol S)
4-hydroxy-4'-isopropoxydiphenylsulfone (NY-DS)
4-hydroxy-4'-n-butyloxydiphenylsulfone
4-hydroxy-4'-n-propoxydiphenylsulfone
4-hydroxyacetophenone
4-hydroxybenzoyloxy α-naphthyl benzoate
4-hydroxybenzoyloxy β-naphthyl benzoate
4-hydroxybenzoyloxy β-phenethyl benzoate
4-hydroxybenzoyloxybenzyl benzoate
4-hydroxybenzoyloxybutyl benzoate
4-hydroxybenzoyloxycyclohexyl benzoate
4-hydroxybenzoyloxyethyl benzoate
4-hydroxybenzoyloxyhexyl benzoate
4-hydroxybenzoyloxyisopropyl benzoate
4-hydroxybenzoyloxymethyl benzoate
4-hydroxybenzoyloxynonyl benzoate
4-hydroxybenzoyloxyoctyl benzoate
4-hydroxybenzoyloxypropyl benzoate
4-hydroxybenzoyloxysec-butyl benzoate
4-hydroxybenzoyloxytert-butyl benzoate
4-hydroxybenzyl benzoate
4-hydroxybutyl benzoate
4-hydroxydibenzyl phthalate
4-hydroxydihexyl phthalate
4-hydroxydiisopropyl phthalate
4-hydroxydimethyl phthalate
4-hydroxyethyl benzoate
4-hydroxyisobutyl benzoate
4-hydroxyisopropyl benzoate
4-hydroxymethylbenzyl benzoate
4-hydroxyphenyl-1'-naphtalenesulfonate
4-hydroxyphenyl-2'-ethyl-4'-hydroxyphenylsulfone
4-hydroxyphenyl-2'-isopropyl-4'-hydroxyphenylsulfone
4-hydroxyphenyl-2'-naphtalenesulfonate
4-hydroxyphenyl-3'-isopropyl-4'-hydroxyphenylsulfone
4-hydroxyphenyl-3'-sec-butyl-4'-hydroxyphenylsulfone
4-hydroxyphenylbenzenesulfonate
4-hydroxyphenylmethylenesulfonate
4-hydroxyphenyl-p-chlorobenzenesulfonate
4-hydroxyphenyl-p-isopropoxybenzenesulfonate
4-hydroxyphenyl-p-tert-butylbenzenesulfonate
4-hydroxyphenyl-p-tolylsulfonate
4-hydroxypropyl benzoate
benzyl-4-hydroxyphenylacetate
bis-(2,3,4-trihydroxyphenyl)sulfide
bis-(2,3-dimethyl-4-hydroxyphenyl)sulfone
bis-(2,4,5-trihydroxyphenyl)sulfide
bis-(2,5-dimethyl-4-hydroxyphenyl)sulfone
bis-(2-ethyl-4-hydroxyphenyl)sulfone
bis-(2-isopropyl-4-hydroxyphenyl)sulfone
bis-(3-chloro-4-hydroxyphenyl)sulfone
bis-(3-ethyl-4-hydroxyphenyl)sulfone
bis-(3-methoxy-4-hydroxyphenyl)sulfone
bis-(3-methyl-4-hydroxyphenyl)sulfone
bis-(3-propyl-4-hydroxyphenyl)sulfone
bis-(4,5-dihydroxy-2-tert-butylphenyl)sulfide
bis-(4-hydroxy-2,3-dimethylphenyl)sulfide
bis-(4-hydroxy-2,3,6-trimethylphenyl)sulfide
bis-(4-hydroxy-2,5-diisopropylphenyl)sulfide
bis-(4-hydroxy-2,5-dimethylphenyl)sulfide
bis-(4-hydroxy-2,5-diphenylphenyl)suifide
bis-(4-hydroxy-2-cyclohexyl-5-methylphenyl)sulfide
bis-(4-hydroxy-2-methyl-5-ethylphenyl)sulfide
bis-(4-hydroxy-2-methyl-5-isopropylphenyl)sulfide
bis-(4-hydroxy-2-tert-octyl-5methylphenyl)sulfide
bis-(4-hydroxy-3-tert-butyl-6-methylphenyl)sulfide
bis-(phenyl3-1,butyl-4-hydroxy-6-methylphenyl)sulfone
monobenzyl phthalate
monocyclohexyl phthalate
monoethoxybenzyl phthalate
monoethylphenyl phthalate
monohalogenbenzyl phthalate
monomethylphenyl phthalate
monophenyl phthalate
monopropylbenzyl phthalate
novolac type phenolic resin
p,p'-(1-methyl-n-hexylidene)diphenol
p-benzylphonol
p-phenylphenol
p-tert-butylphenol As (black) color formers are used for example:

3-(dibutylamino)-6-methyl-7-anilinofluoran
3-(dibutylamino)-7-(2-chlorophenylamino)fluoran
3-(diethylamino)-6-chloro-7-anilinofluoran
3(diethylamino)-6-methyl-7-(2,4-dimethylphenylamino) fluoran
3-(diethylamino)-6-methyl-7-(3-methylphenylamino) fluoran (ODB-7)
3-(diethylamino)-6-methyl-7-anilinofluoran
3-(diethylamino)-7-(3-trifluoromethylphenylamino)fluoran
3-(dipentylamino)-6-methyl-7-anilinofluoran
3-(N-ethyl-N-isobutylamino)-6-methyl-7-anilinofluoran
3-(N-ethyl-N-isopentylamino)-6-methyl-7-anilinofluoran (S 205)
3-(N-ethyl-N-isopentylamino)-7-(2-chlorophenylamino) fluoran
3-(N-ethyl-N-p-tolylamino)-6-methyl-7-anilinofluoran
3-(N-methyl-N-cyclohexylamino)-6-methyl-7-anilinofluoran
3-(N-methyl-N-propylamino)-6-methyl-7-anilinofluoran 3-(N-tetrahydrofurfuryl-N-ethylamino)-6-methyl-7-anilinofluoran
3-[N-ethyl N-(3-ethoxypropyl)amino]-6-methyl-7-anilinofluoran Sensitizers are for example:
1-(4-methoxyphenoxy)-2-(2-methylphenoxy)ethane
1,2-bis(phenoxymethyl)benzene
1,2-di(3-methylphenoxy)ethane
1,2-di(4-chlorophenoxy)ethane
1,2-di(4-methoxyphenoxy)ethane
1,2-di(4-methylphenoxy)ethane
1,2-diphenoxyethane
1,4-di(phenylthio)buthane
1-hydroxy-2-phenylnaphthoate
1-isopropylphenyl-2-phenylethane
2-naphtylbenzylether
4-(4-tolyloxy)biphenyl (JKY-120)
4-biphenyl-p-tolyether
behenic acid amidemethylene-bis-stearic acis amide
di(p-methoxyphenoxyethyl)ether
di-(β-biphenylethoxy)benzene
dibenzyl terephthalate
dibenzyloxalate
dimethyl terephthalate
dioctyl terepthalate
di-p-chlorobenzyloxalate
di-p-methylbenzyloxalate
di-p-tolylcarbonate
ethylene-bis-stearic acid amide
methoxycarbonyl-N-benzamidestearate
methylene-bis-stearic acid amide
methyloamide
m-terphenyl
N-acetoacetyl-p-toluidine
N-benzoylstearic acid amide
N-eicosenoic acid amide
N-methylostearic acid amide
o-toluenesulfonamide
p-acetophenetidide
p-actotoluidide
palmitic acid amide
p-benzylbiphenyl
p-benzyloxybenzylbenzoate
p-di(vinyloxyethoxy)benzene
phenyl-α-naphtylcarbonate
p-methylthiophenylbenzylether
p-toluenesulfonamide
stearic acid amide The color former, the developer and the sensitizer are dispersed into liquid, usually water, together with a suitable binder.

Figure 4:
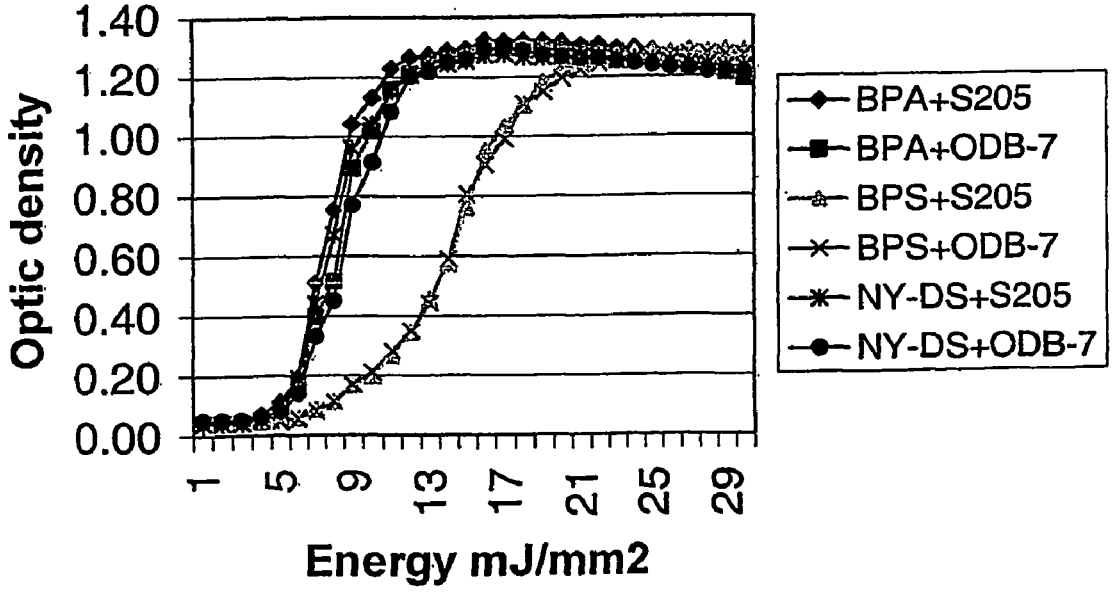
FIG. 4 illustrates the sensibility of different color former-developer compounds.
Figure 6:
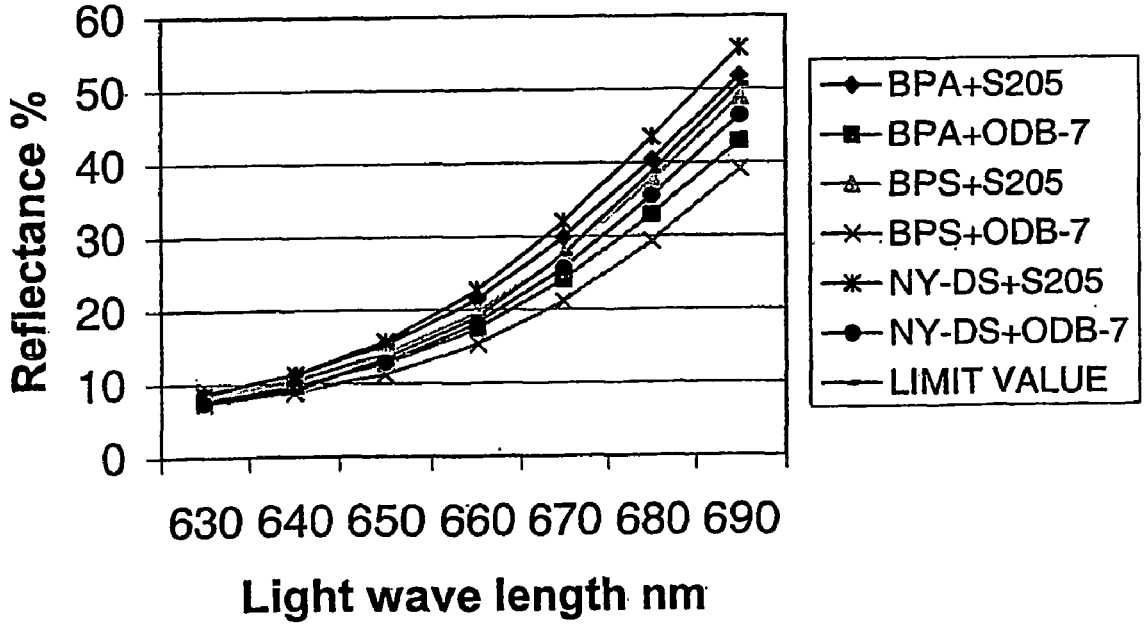
FIG. 6 illustrates reflectance curves obtained with color former-developer compounds according to a preferred embodiment of the invention, with both curves obtained with prior art compounds, and the limit value curve with a certain optic density (1.15)
Figure 7:
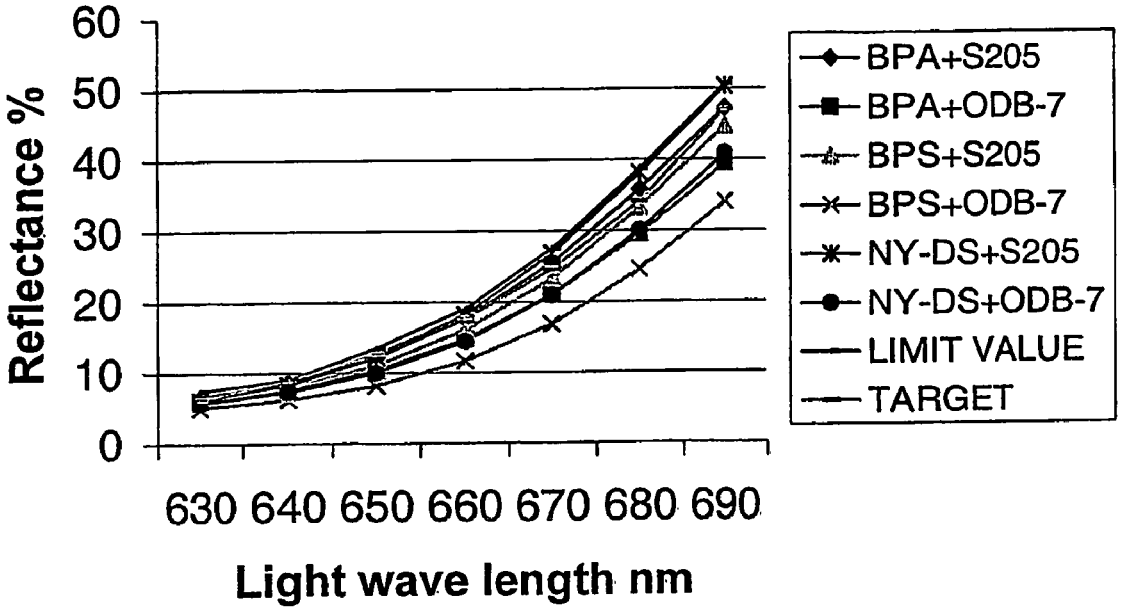
FIG. 7 illustrates reflectance curves obtained with color former-developer compounds according to a preferred embodiment of the invention, with both curves obtained with prior art compounds, the initial, the limit value and the target curve with a certain optic density (1.30)

As binders are used for example:
amide-modified polyvinylalcohol
carpoxymethylcellulose
carpoxy-modified polyvinyl alcohol
casein
gelatin
hydroxyethylcellulose
methylcellulose
petroleum resins
polyacrylamide
polyacrylic acid
polyacrylic acid esters
polyamide resins
polyvinyl acetate
polyvinyl alcohol
silicone-modified polyvinyl alcohol
starch
styrene-butadiene copolymer
styrene-maleic acid copolymer
sulfonic acid-modified polyvinyl alcohol
terpene resins Further, fillers are used in paper production in manners known per se; filler are for example:
aluminium hydroxide
calcined caolin
calcium carbonate
diatomaceous earth
kaolin
nylon powder
silica
styrene microballs
talc
titanium oxide
ureaformaline resin Further, "lubricants" are used in paper production, which are for example:
polyethylene wax
stearic acid ester wax
zinc stearate Test we have performed have proved that it is possible to use as a color former in the thermal paper according to our invention a color former, which is known per se under the commercial name ODB-7; the light absorption with this chemical at a wavelength of over 630 nm is higher (and correspondingly reflectance is weaker) than with for example the coler former S205 which is the most popular today (cf. for example FIGS. 6 and 7). As a developer can be used for example 4,4'-isopropylidenediphenol, commercial name Bisphenol A or a shorter name BPA, which is commonly used. However, according to our studies, another possible developer is surprisingly 4,4'-sulfonyldiphenol, commercial name Bisphenol S or BPS. BPS is the cheapest of the chemicals used and also the least sensitive, and because of this unsensitive property it has not been extensively used in the production of thermal paper. FIG. 4 illustrates a comparison between the sensitivity of BPS and that of other known developers. Sensitivity here means the amount of energy required for producing an image; thus, the smaller the energy required is the better is the sensitivity. The figure illustrates that the use of BPS calls for open-mindedness as its behavior deviates so much from that of the other developers. However, it has been surprisingly found out that the use of the compound ODB-7-BPS, and in particular the use of BPS as the developer, produces a substantially better result in the bar code readability than the use of other possible chemical compounds (cf. FIGS. 6–9). It has also been found out that the preservability of the bar code has improved significantly.

The test we have performed are described below with reference to the accompanying tables. At first the test apparatus is described.

The bar code reader was a PSC Quick check® PC600 PC bar code reading system, which is commonly used and produced by PCS Inc. The thermal printers were devices of two different manufacturers. One was thermal printer Model 200 by Atlantek, where the print head is KYOCERA KST-216-8MPD1 with R=639Ω. The other printer was thermal printer Model MP104 by Markpoint, having a print head Mitsu EP104-8X, 800 ohm, produced by Mitsubishi. The optic density was determined with a Macbeth meter RD-918 without a filter. The reflectance values were measured with an L&W Elrepho spectrophotometer by Lorenzen & Wettre.

The light used in the tests was C/2, which corresponds to a normal office lighting. The filter was an UV filter run by light C.

EXAMPLE 1

In the first test, the results of which are presented in Table 1, the degree of density of a bar code was measures at different heat energies projected on a square millimeter of a thermal paper and by using different chemical compounds in the heat sensitive material In the test, samples of thermal papers were used which had been produced by using BPA, BPS or NY-DS as the developer and either ODB-7 or S205 as the color former. The amount of energy directed to the thermal paper was changed and the degree of density of the printed color was measured.

TABLE 1

| Test | mJ/mm$^2$ | 1-1/BPA + S205 | 1-3/BPA + ODB-7 | 2-1/BPS + S205 | 2-3/BPS + ODB-7 | 3-1/NY-DS + S205 | 3-3/NY-DS + ODB-7 |
|---|---|---|---|---|---|---|---|
| #1 | 3.5 | 0.04 | 0.04 | 0.04 | 0.04 | 0.04 | 0.05 |
| #2 | 4.6 | 0.05 | 0.04 | 0.04 | 0.04 | 0.04 | 0.05 |
| #3 | 5.8 | 0.05 | 0.04 | 0.04 | 0.04 | 0.04 | 0.05 |
| #4 | 7.0 | 0.07 | 0.05 | 0.05 | 0.05 | 0.05 | 0.06 |
| #5 | 8.1 | 0.11 | 0.08 | 0.05 | 0.05 | 0.08 | 0.08 |
| #6 | 9.3 | 0.19 | 0.15 | 0.06 | 0.06 | 0.19 | 0.14 |
| #7 | 10.4 | 0.51 | 0.40 | 0.09 | 0.08 | 0.44 | 0.33 |
| #8 | 11.6 | 0.75 | 0.52 | 0.11 | 0.11 | 0.67 | 0.45 |
| #9 | 12.8 | 1.04 | 0.89 | 0.17 | 0.17 | 0.96 | 0.77 |
| #10 | 13.9 | 1.13 | 1.02 | 0.20 | 0.21 | 1.04 | 0.91 |
| #11 | 15.1 | 1.23 | 1.16 | 0.27 | 0.28 | 1.15 | 1.08 |
| #12 | 16.2 | 1.27 | 1.21 | 0.34 | 0.35 | 1.21 | 1.20 |
| #13 | 17.4 | 1.28 | 1.25 | 0.46 | 0.44 | 1.23 | 1.22 |
| #14 | 18.6 | 1.29 | 1.26 | 0.57 | 0.59 | 1.24 | 1.25 |
| #15 | 19.7 | 1.29 | 1.27 | 0.76 | 0.81 | 1.26 | 1.26 |
| #16 | 20.9 | 1.32 | 1.29 | 0.95 | 0.91 | 1.27 | 1.30 |
| #17 | 22.0 | 1.32 | 1.30 | 1.03 | 0.99 | 1.28 | 1.30 |
| #18 | 23.2 | 1.32 | 1.30 | 1.11 | 1.11 | 1.27 | 1.29 |
| #19 | 24.4 | 1.32 | 1.29 | 1.18 | 1.15 | 1.27 | 1.27 |
| #20 | 25.5 | 1.32 | 1.29 | 1.23 | 1.20 | 1.27 | 1.27 |
| #21 | 26.7 | 1.31 | 1.29 | 1.24 | 1.22 | 1.27 | 1.26 |
| #22 | 27.8 | 1.31 | 1.29 | 1.26 | 1.24 | 1.27 | 1.26 |
| #23 | 29.0 | 1.29 | 1.28 | 1.27 | 1.25 | 1.26 | 1.25 |
| #24 | 30.2 | 1.30 | 1.27 | 1.28 | 1.26 | 1.26 | 1.25 |
| #25 | 31.3 | 1.29 | 1.27 | 1.28 | 1.27 | 1.26 | 1.24 |
| #26 | 32.5 | 1.27 | 1.26 | 1.28 | 1.27 | 1.25 | 1.23 |
| #27 | 33.6 | 1.26 | 1.24 | 1.29 | 1.28 | 1.24 | 1.23 |
| #28 | 34.8 | 1.25 | 1.23 | 1.28 | 1.28 | 1.24 | 1.22 |
| #29 | 36.0 | 1.22 | 1.21 | 1.29 | 1.27 | 1.23 | 1.22 |
| #30 | 37.1 | 1.21 | 1.19 | 1.28 | 1.27 | 1.23 | 1.21 |

The results in Table 1 indicate that BPS as a developer is very unsensitive which in practice means that in order to achieve the same degree of density BPS requires about twice the amount of heat energy compared with other developers. Not until at very high degrees of density, more than 1.25, the heat energies required by other developers reach BPS. In practice, FIG. 4 shows to a person of ordinary skill in the art that BPS is not worth using as a developer as it imposes greater demands on the printer and increases the energy consumption of the printing.

EXAMPLE 2

For Table 2, the thermal paper samples described in Example 1 were tested to find out the preservability of the color. The samples, on which the bar code had been printed with black color, were treated as follows:

Test 1: soaking in water for two hours,

Test 2: sample covered with oil, measuring after one hour of treatment

Test 3: sample covered with oil, measuring after 24 hours of treatment

Test 4: sample wrapped in a PVC plastic foil, temperature 23° C., measuring after two hours;

Test 5: sample wrapped in a PVC plastic foil, temperature 23° C., measuring after 24 hours; and Test 6: sample wrapped in a PVC plastic foil, temperature 40° C., measuring after 24 hours.

Both oil and the softeners in the PVC tend to restore the reversible color reaction to its initial state.

Table 2 shows in percentage the share of the print image density remaining in the paper at the measuring moment.

TABLE 2

| Test | 1-1/BPA + S205 | 1-3/BPA + ODB-7 | 2-1/BPS + S205 | 2-3/BPS + ODB-7 | 3-1/NY-DS + S205 | 3-3/NY-DS + ODB-7 |
|---|---|---|---|---|---|---|
| #1 | 46.4 | 55.6 | 68.3 | 71.8 | 69.9 | 71.2 |
| #2 | 30.2 | 39.7 | 87.0 | 90.5 | 63.3 | 80.9 |
| #3 | 20.4 | 20.6 | 87.0 | 87.9 | 22.7 | 77.8 |
| #4 | 18.7 | 22.2 | 99.8 | 103.0 | 62.7 | 67.6 |
| #5 | 3.1 | 3.9 | 16.0 | 46.3 | 4.0 | 4.8 |
| #6 | 3.1 | 3.1 | 7.5 | 11.0 | 1.6 | 1.6 |

Figure 5:
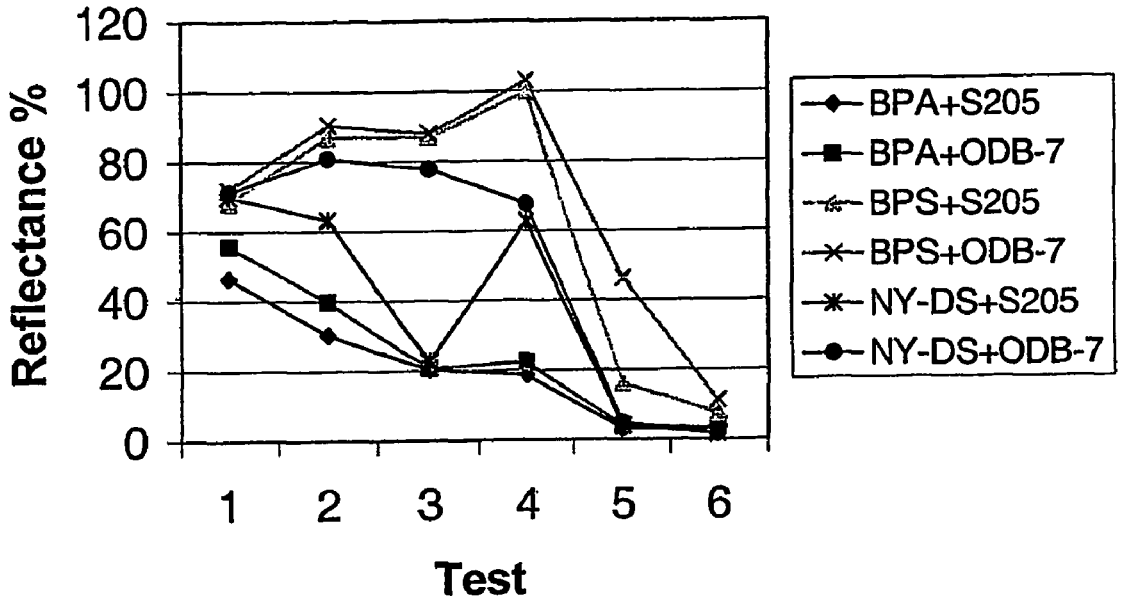
FIG. 5 illustrates a comparison of different color former-developer compounds when they are subjected to different test stresses.

When comparing different developers with each other it can be seen that BPS is clearly different from BPA throughout the whole test range. When compared with NY-DS, there is no difference in the water soaking, but in the oil tests and in particular in the plastic foil tests the difference was very clear. The result of test 4 with a compound of BPS and ODB-7 indicates that the print image has even become denser than the original print. The test results have been illustrated also in FIG. 5, which indicates even more clearly the superiority of BPS in all tests compared with other developers.

In examples 3 and 4 the reflectance of light from bar codes was studied with the thermal paper samples described in example 1. In example 3, the thermal energy used in the printing of the bar code was the average whereas in example 4, a higher thermal energy was used to produce the image. The bar code reflections were determined in both examples by using wavelengths 630–690 nm with intervals of 10 nm. The light and the filter used in all the test were the same.

EXAMPLE 3

In the tests of this example, samples of essentially the same bar code density, i.e. 1.13–1.16, were used.

The test results indicate that with all the wavelengths, all the color formers and all the developers, the BPS developer gave as a rule the smallest reflection.

The average reflection with BPS was about 10–20% lower than with other developers.

The results of the test are presented in FIG. 6, where additionally both a limit value curve representing the minimum requirements of the customers and a curve representing the target value determined by ourselves are included. The reflectance values obtained with the target curve result according to our tests in the bar code reading in an error margin of less than one percent, only, which is clearly smaller than the error margin accepted by the customers. We have determined a mathematical function the descriptor of which sets with a reasonable accuracy on the limit value curve of the customers. The function in question is of the form $$Hp=1.775*Ap^{22}*10^{-61},$$

where Hp is the reflection percent (%) and Ap the light wavelength (nm) employed by the bar code reader.

From this, we have come to the target curve by moving the curve 7% down which is performed by multiplying the values of the limit value curve by 0.93. Then the target curve is of the form $$Hp=1.651*Ap^{22}*10^{-61}.$$

TABLE 3

| | 1-1/BPA + S205 | 1-3/BPA + ODB-7 | 2-1/BPS + S205 | 2-3/BPS + ODB-7 | 3-1/NY-DS + S205 | 3-3/ NY-DS + ODB-7 |
|---|---|---|---|---|---|---|
| Density | 1.16 | 1.15 | 1.15 | 1.13 | 1.14 | 1.16 |
| Light | C/2 | C/2 | C/2 | C/2 | C/2 | C/2 |
| Filter | C/UV | C/UV | C/UV | C/UV | C/UV | C/UV |
| Wave length/ nm | Reflectance/% | | | | | |
| 630 | 8.68 | 7.72 | 8.22 | 7.24 | 8.47 | 7.45 |
| 640 | 11.25 | 9.66 | 10.43 | 8.8 | 11.27 | 9.54 |
| 650 | 15.28 | 12.71 | 13.99 | 11.28 | 15.72 | 12.92 |
| 660 | 21.46 | 17.47 | 19.58 | 15.3 | 22.65 | 18.25 |
| 670 | 29.83 | 24.09 | 27.36 | 21.13 | 31.9 | 25.64 |
| 680 | 40.38 | 32.86 | 37.56 | 29.27 | 43.48 | 35.42 |
| 690 | 51.73 | 42.87 | 48.85 | 39.02 | 55.57 | 46.38 |

EXAMPLE 4

In this test, higher thermal energy was used to form the image whereby the density of the samples varied between 1.30–1.33.

TABLE 4

| | 1-1/BPA + S205 | 1-3/BPA + ODB-7 | 2-1/BPS + S205 | 2-3/BPS + ODB-7 | 3-1/NY-DS + S205 | 3-3/ NY-DS + ODB-7 |
|---|---|---|---|---|---|---|
| Density | 1.32 | 1.31 | 1.3 | 1.33 | 1.3 | 1.31 |
| Light | C/2 | C/2 | C/2 | C/2 | C/2 | C/2 |
| Filter | C/UV | C/UV | C/UV | C/UV | C/UV | C/UV |
| Wave length/nm | Reflectance/% | | | | | |
| 630 | 6.54 | 5.96 | 6.19 | 5.07 | 6.14 | 5.77 |
| 640 | 8.62 | 7.6 | 7.98 | 6.21 | 8.35 | 7.32 |
| 650 | 12.08 | 10.3 | 10.98 | 8.16 | 12.09 | 9.98 |
| 660 | 17.65 | 14.69 | 16.02 | 11.6 | 18.17 | 14.4 |
| 670 | 25.45 | 20.98 | 23.28 | 16.84 | 26.81 | 20.95 |
| 680 | 35.79 | 29.5 | 33.27 | 24.54 | 38.06 | 30.06 |
| 690 | 47.24 | 39.44 | 44.7 | 34.07 | 50.34 | 40.83 |

Tests results indicate that also with a higher degree of density, BPS still gives a substantially lower reflectance than other developers. In practice, the difference same order as above, i.e. 10–20%.

Figure 8:
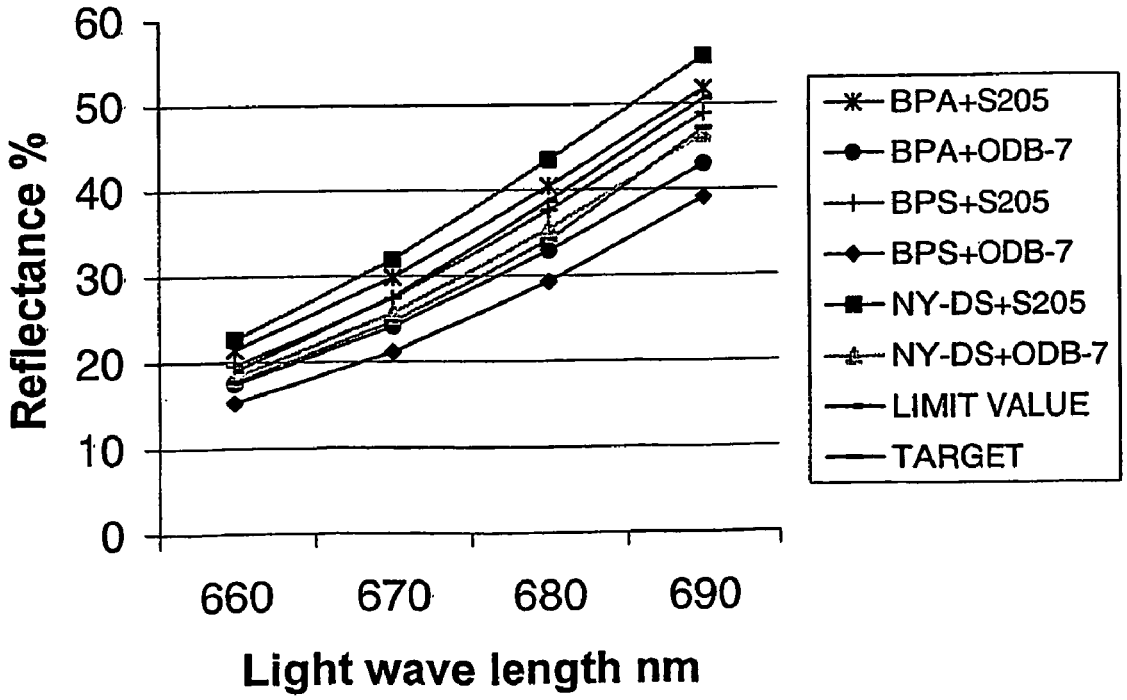
FIG. 8 illustrates reflectance curves obtained with a certain wavelength with color former-developer compounds according to a preferred embodiment of the invention, with both curves obtained with prior art compounds, and the limit value and the target curve with a certain optic density (1.15)
Figure 9:
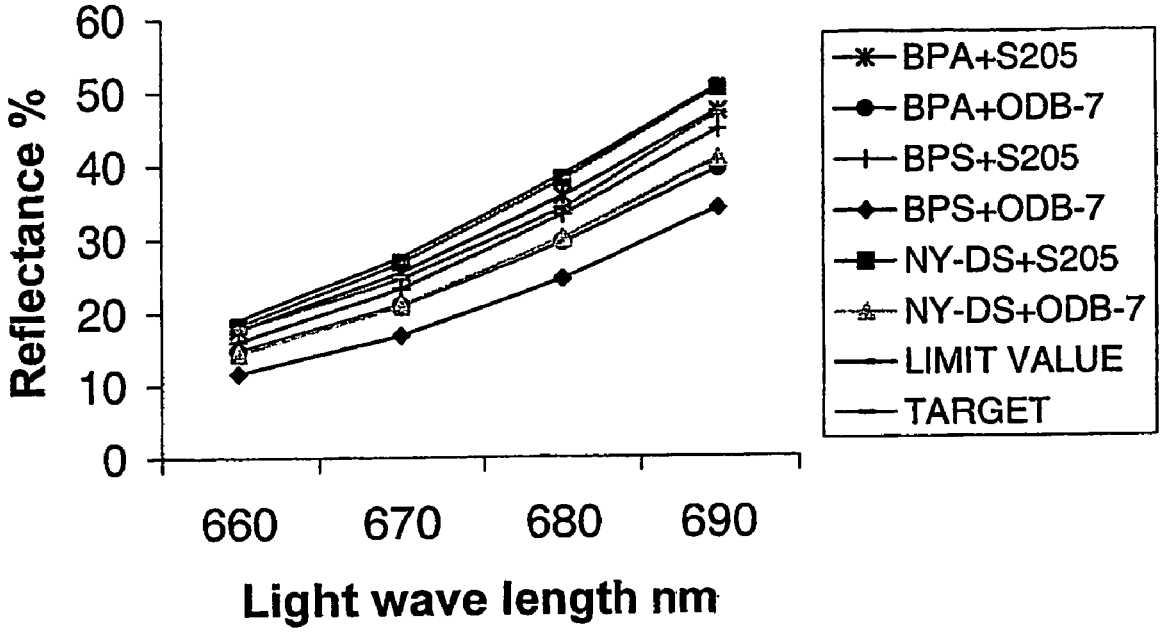
FIG. 9 illustrates reflectance curves obtained with a certain wavelength with color former-developer compounds according to a preferred embodiment of the invention, with both curves obtained with prior art compounds, the initial, the limit value and the target curve with a certain optic density (1.30).

FIGS. 8 and 9 illustrate the test results of the above examples 4 and 5 in a little broader scale by showing on the co-ordinates only the light wavelength range 660–690 nm the more modern bar code readers use. The figures indicate that by using BPS as the developer, the reflectance at the wavelength 690 nm is at its best less than 35% while the color former-developer compounds used earlier have hardly reached a reflectance of below 40%.

In the situation of FIG. 8, where the optic density was the average, i.e. about 1.15, only two of the tested color former-developer compounds reached below the target curve. The color former in both of these was ODB-7 and in one compound the developer was BPA and in the other one BPS.

In the situation of FIG. 9, where the optic density was about 1.31, four color former-developer compounds reached below the target curve. In three of the cases the color former was ODB-7 and in one it was S205. In two of the cases the developer was BPS and once both BPA and NY-DS.

Thus it may be concluded that a recommendable color former would be ODB-7 or any color former with corresponding properties of the ones described on pages 10 and 11. Correspondingly, a recommendable developer is BPS or any developer with corresponding properties of the ones listed on pages 7–10.

The solution according to the invention allows using conventional prior art sensitizers, which have been listed above on pages 11 and 12 as far as it does not prevent the desired effect of the invention.

In addition to the improved readability of the bar code, the solution according to the invention provides also for an improved preservability of the bar code. Further, if BPS is used as the developer, the coating is very inexpensive.

The invention may be employed in all applications of thermal paper where bar codes and LED or laser readers are used, such as for example price tags, entrance tickets and in weighing fruit.

We claim:

1. A method of manufacturing heat sensitive recording material for bar code readers capable of reading bar codes at a wavelength range of 660–690 nm, the method comprising applying a coating onto a base layer, wherein the coating comprises 3-(diethylamino)-6-methyl-7-(3-methylphenylamino)fluoran (ODB-7) as a color former, and 4,4'-sulfonyldiphenol (Bisphenol S) as a developer.

2. A heat sensitive recording material comprising a base layer and a coating on the base layer, wherein the coating comprises 3-(diethylamino)-6-methyl-7-(3-methylphenylamino)fluoran (ODB-7) as a color former, and 4,4'-sulfonyldiphenol (Bisphenol S) as a developer.

* * * * *